US012364292B2

(12) United States Patent
Garrin

(10) Patent No.: US 12,364,292 B2
(45) Date of Patent: Jul. 22, 2025

(54) GARMENT WITH BREAST COVERAGE

(71) Applicant: Wanda Garrin, Monmouth Junction, NJ (US)

(72) Inventor: Wanda Garrin, Monmouth Junction, NJ (US)

( * ) Notice: Subject to any disclaimer, the term of this patent is extended or adjusted under 35 U.S.C. 154(b) by 129 days.

(21) Appl. No.: 18/105,608

(22) Filed: Feb. 3, 2023

(65) Prior Publication Data

US 2023/0240384 A1 Aug. 3, 2023

Related U.S. Application Data

(60) Provisional application No. 63/306,125, filed on Feb. 3, 2022.

(51) Int. Cl.
*A41C 3/08* (2006.01)

(52) U.S. Cl.
CPC ..... *A41C 3/08* (2013.01)

(58) Field of Classification Search
CPC ..... A41C 3/08
USPC ..... 450/30–33
See application file for complete search history.

(56) References Cited

U.S. PATENT DOCUMENTS 5,983,394 A * 11/1999 Joo ..... A41D 1/04 450/55
11,406,141 B2 * 8/2022 Lucas Gaus ..... A41C 3/0035
2014/0099864 A1 * 4/2014 Moulden ..... A41C 3/08 450/31

* cited by examiner

*Primary Examiner* — Gloria M Hale
(74) *Attorney, Agent, or Firm* — The Rapacke Law Group, P.A.; Andrew Rapacke

(57) ABSTRACT

A three-ply garment may provide coverage for wearers in the form of a soft, body-hugging garment with no elastic bands, no restrictive sides or back bands which may compress the body and cause discomfort and pain. The garment may include no underwire, no straps which may uncomfortably dig into the wearer's skin, no clasps, no front closures, no back closures, or similar uncomfortable, bulky, or rigid connectors or supports. The garment may include a support layer including molded cups or pads or other materials or fabric including support seams to provide circumferential support when worn.

14 Claims, 4 Drawing Sheets

GARMENT WITH BREAST COVERAGE

CROSS-REFERENCE TO RELATED APPLICATIONS

The present application claims priority to U.S. Provisional Patent Application No. 63/306,125 filed Feb. 3, 2022, entitled "GARMENT WITH BREAST COVERAGE" which is hereby incorporated by reference in its entirety.

TECHNICAL FIELD

The embodiments generally relate to garments and more particularly to form fitting and supportive garments.

BACKGROUND

There is a need in the women's clothing market for a comfortable garment that women can easily slip on in a matter of seconds and experience comfort while maintaining a natural and form fitting look with coverage. This need may be overcome with a three-ply garment that is comfortable while also providing breast coverage for the wearer without the need for a traditional bra.

SUMMARY

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

In general, the embodiments described herein relate to a garment that provides coverage and soft support without the need to wear a traditional bra or sports bra underneath. This garment eliminates the need for annoying bra straps which fall off the shoulders or dig into the skin; painful or uncomfortable underwires which hurt and confine the body; itchy, rash producing, tight elastic bands which encircle the torso; confining side straps which create side bulge; and back straps and clasps which compress and hurt the back and can create back bulge. The garment features non-removable cups or pads or other materials or fabric which do not fall out or shift around within the garment. The garment may include three-ply garment construction to keep the integrity of the garment intact, making it easy to slip on, wear, wash and dry.

Other illustrative variations within the scope of the invention will become apparent from the detailed description provided hereinafter. The detailed description and enumerated variations, while disclosing optional variations, are intended for purposes of illustration only and are not intended to limit the scope of the invention.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1A:
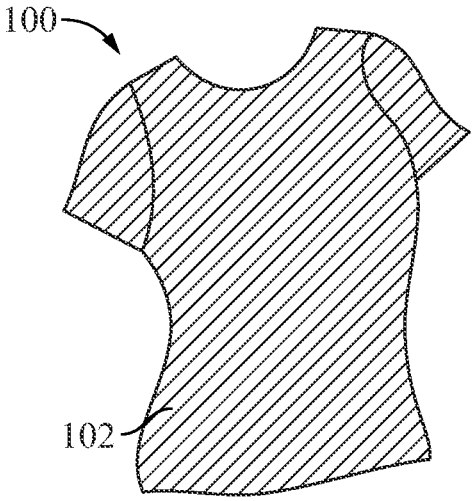
FIG. 1A illustrates a front elevation view of the garment, according to some embodiments.

The specific details of the single embodiment or variety of embodiments described herein are to the described system and methods of use. Any specific details of the embodiments are used for demonstration purposes only and no unnecessary limitations or inferences are to be understood from there.

It is noted that the embodiments reside primarily in combinations of components and procedures related to the system. Accordingly, the system components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments described herein relate to a three-ply garment which may provide coverage for wearers in the form of a soft, body-hugging garment with no elastic bands, no restrictive sides or back bands which may compress the body and cause discomfort and pain. The garment may include no underwire, no straps which may uncomfortably dig into the wearer's skin, no clasps, no front closures, no back closures, or similar uncomfortable, bulky, or rigid connectors or supports.

In general, the embodiments described herein may include a garment such as a t-shirt, tank top, or the like which may encompass various sleeve lengths, necklines, torso lengths, and the like.

In general, the embodiments described herein relate to a three-ply garment which may include a first front outer layer, a second inner support layer, and a third back outer layer.

According to some embodiments, the first front outer layer and the third back outer layer may include identical, near identical, or varied materials or fabrics. According to some embodiments, the first outer layer and the third outer may include shape providing benefits via materials such as spandex, elastane, lycra, modal, or other type of elastic material.

The second inner support layer may be sewn, glued, fused, or otherwise attached in place to an interior of the first front outer layer to prevent shifting of the second inner support layer during use and such that the second inner support layer is covered by the first front outer layer. According to some embodiments, the second inner support layer may include multiple portions including a second layer first portion and a second layer support portion. The second layer first portion and the second layer support portion may be attached to one another. The second layer first portion may include a material similar to or identical to that of the first front outer layer or the third back outer layer.

The second inner support layer may include a support system constructed of molded cups, mesh, nylon, spandex, or other material to provide support to a wearer's breasts. Alternatively, the support system may be a soft breast pad or breast pads or other materials or fabric including a combination of materials designed to provide a soft natural silhouette. The thickness and diameter of molded cups, breast pads, or other components of the support system may include a variety of suitable materials. The support system may include a soft, flexible support band disposed under the support system and under the breasts of a wearer to provide a natural, nonrestrictive support of the wearers breasts. Additionally, the support system may include a center pucker or gathering of the material of the second inner support layer or first front outer between support cups or pads to provide flexible support between the breasts.

Figure 1B:
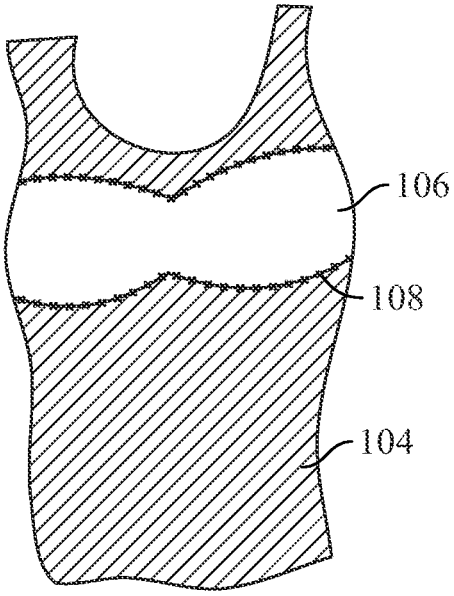
FIG. 1B illustrates a front elevation view of the garment, according to some embodiments.
Figure 1C:
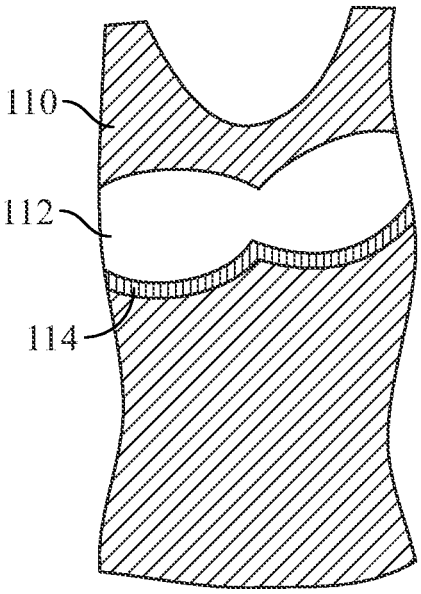
FIG. 1C illustrates a front elevation view of the garment, according to some embodiments.
Figure 1D:
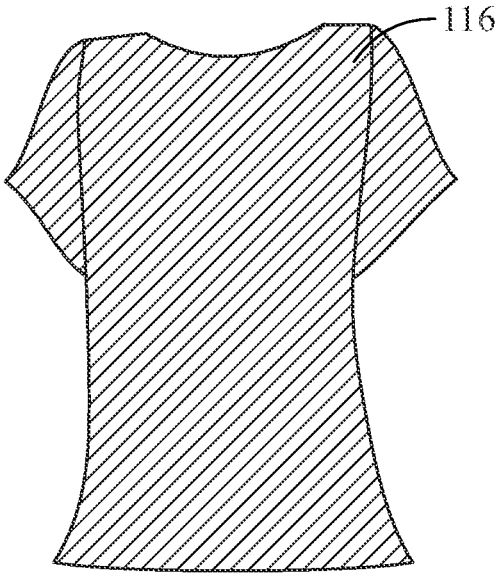
FIG. 1D illustrates a front elevation view of the garment, according to some embodiments.

Referring to FIG. 1A through 1D, a garment 100 may include a first front outer layer 102 opposite a third back outer layer 116. The first front outer layer 102 and the third back outer layer 116 may be made of the same material. A second inner support layer, as seen in FIGS. 1B and 1C may include a support system 104 that may include a backing 106 secured to the support system 104 via a sewn, glued, or fused seam 108. The support system 104 may include molded cups 112 and a support seam 114 disposed on a front portion 110 of the support system 104. The molded cups 112 and backing 106 may be attached to one another to provide circumferential support when worn. With the exception of the backing 106, seam 108, molded cups 112, support seam 114, the support system 104 and front portion 110 may be made of the same material as the first front outer layer 102 and the third back outer layer 116.

Figure 2A:
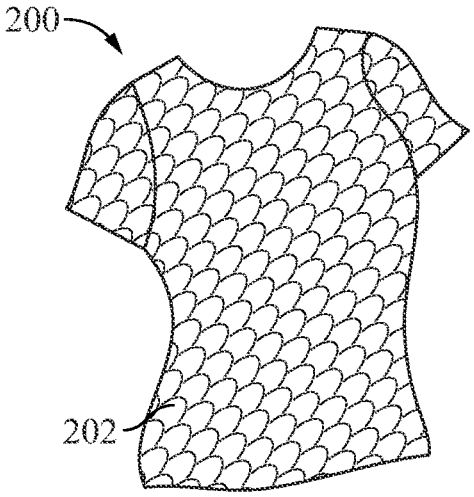
FIG. 2A illustrates a front elevation view of the garment, according to some embodiments.
Figure 2B:
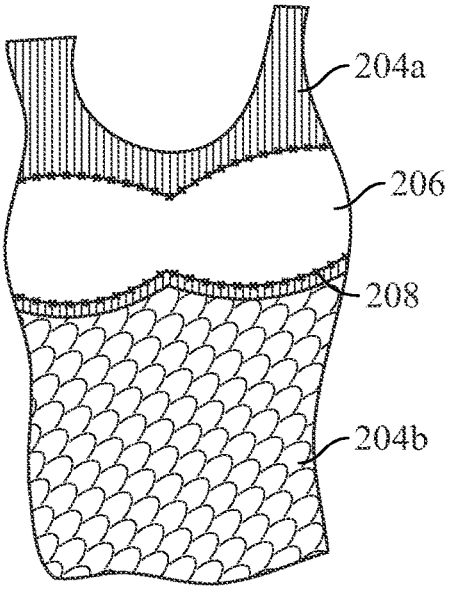
FIG. 2B illustrates a front elevation view of the garment, according to some embodiments.
Figure 2C:
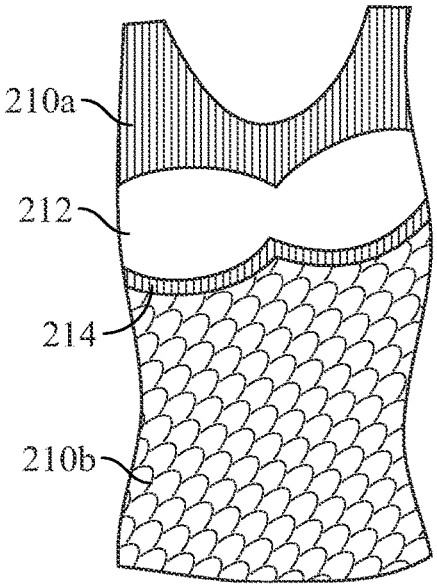
FIG. 2C illustrates a front elevation view of the garment, according to some embodiments.
Figure 2D:
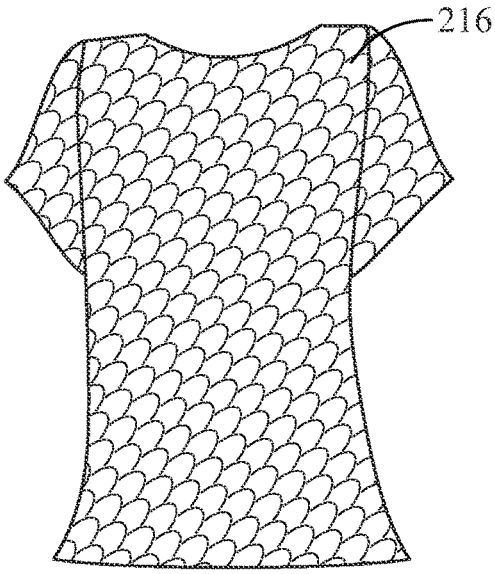
FIG. 2D illustrates a front elevation view of the garment, according to some embodiments.

Referring to FIG. 2A through 2D, a garment 200 may include a first front outer layer 202 opposite a third back outer layer 216. The first front outer layer 202 and the third back outer layer 216 may be made of the same material. A second inner support layer, as seen in FIGS. 2B and 2C may include a support system 204*a* and 204*b* that may include a backing 206 secured to the support system 204*a* and 204*b* via a sewn, glued, or fused seam 208. The support system may include a first support material 204*a*, 210*a* differing from a second support material 204*b*, 210*b*. The support system may include molded cups 212 and a support seam 214 disposed on a front portion 210*a* and 210*b* of the support system. The molded cups 212 and backing 206 may be attached to one another to provide circumferential support when worn.

Figure 3A:
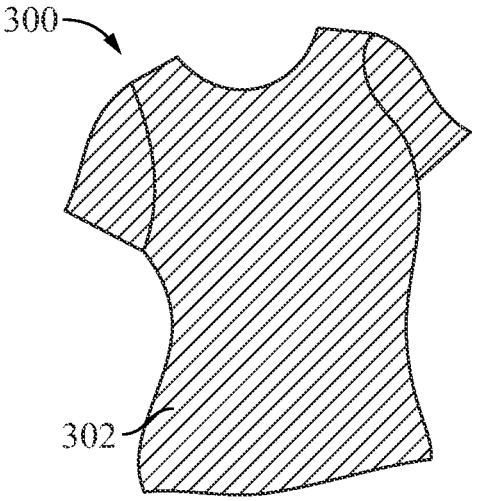
FIG. 3A illustrates a front elevation view of the garment, according to some embodiments.
Figure 3B:
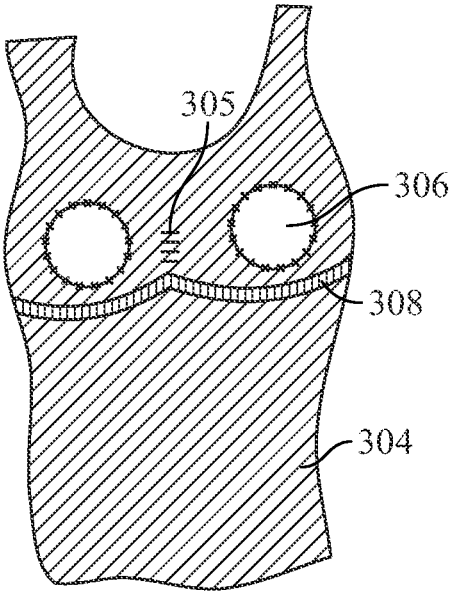
FIG. 3B illustrates a front elevation view of the garment, according to some embodiments.
Figure 3C:
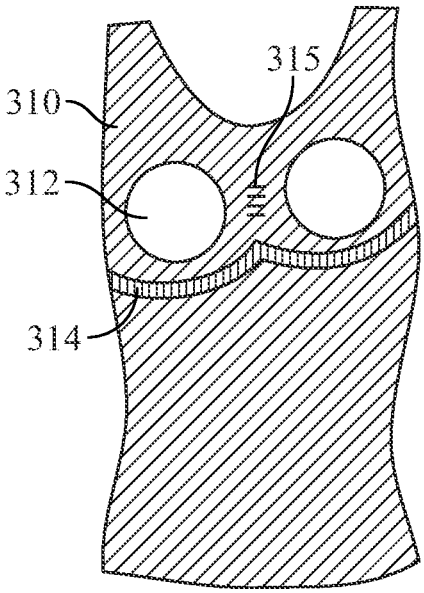
FIG. 3C illustrates a front elevation view of the garment, according to some embodiments.
Figure 3D:
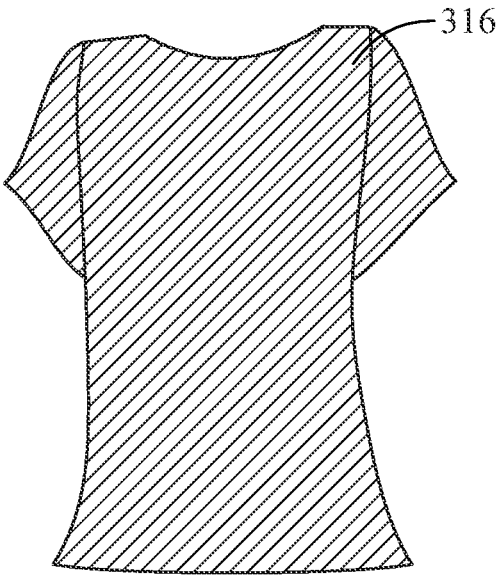
FIG. 3D illustrates a front elevation view of the garment, according to some embodiments.

Referring to FIG. 3A through 3D, a garment 300 may include a first front outer layer 302 opposite a third back outer layer 316. The first front outer layer 302 and the third back outer layer 316 may be made of the same material. A second inner support layer, as seen in FIGS. 3B and 3C may include a support system 304 that may include a backing 306 secured to the support system 304 via a sewn, glued, or fused seam 308. The second inner support layer may include a rear pucker 305 or gathering. The support system 304 may include pads 312 and a support seam 314 disposed on a front portion 310 of the support system 304. Pads 312 may be adhered to the support system 304. The second inner support layer may include a front pucker 315 or gathering. The fused seam 308 and support seam 314 may be attached to one another to provide circumferential support when worn. With the exception of the backing 306, seam 308, pads 312, support seam 314, the support system 304 and front portion 310 may be made of the same material as the first front outer layer 302 and the third back outer layer 316.

Figure 4A:
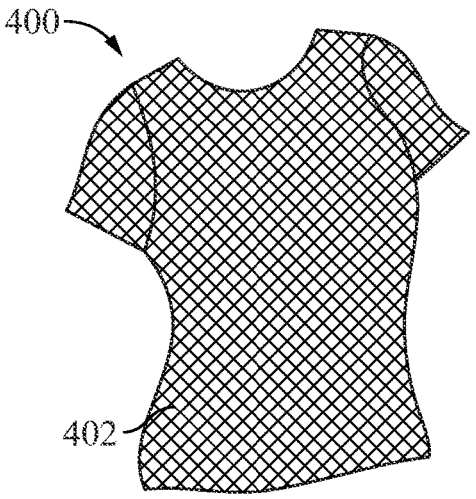
FIG. 4A illustrates a front elevation view of the garment, according to some embodiments.
Figure 4B:
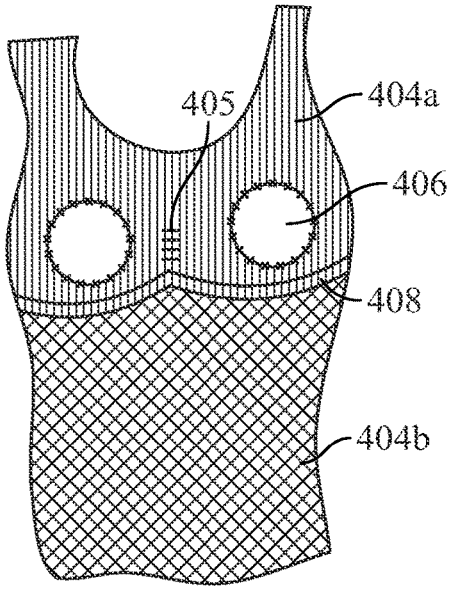
FIG. 4B illustrates a front elevation view of the garment, according to some embodiments.
Figure 4C:
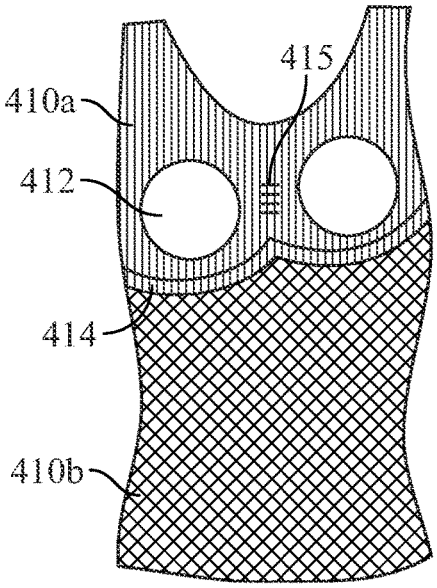
FIG. 4C illustrates a front elevation view of the garment, according to some embodiments.
Figure 4D:
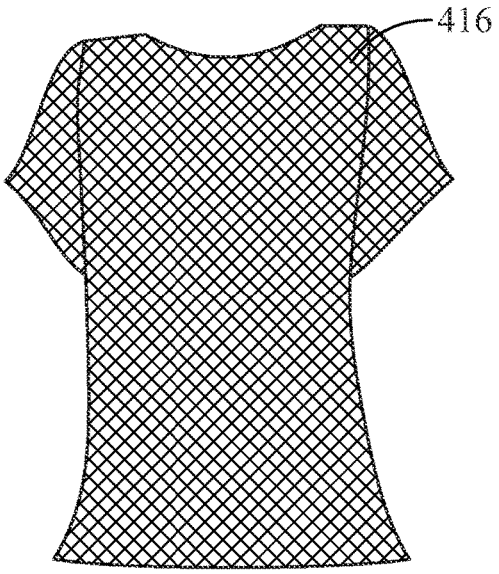
FIG. 4D illustrates a front elevation view of the garment, according to some embodiments.

Referring to FIG. 4A through 4D, a garment 400 may include a first front outer layer 402 opposite a third back outer layer 416. The first front outer layer 402 and the third back outer layer 416 may be made of the same material. A second inner support layer, as seen in FIGS. 4B and 4C may include a support system 404*a* and 404*b* that may include a backing 406 secured to the support system 404*a* and 404*b* via a sewn, glued, or fused seam 408. The support system may include a first support material 404*a*, 410*a* differing from a second support material 404*b*, 410*b*. The support system may include pads 412 and a support seam 414 disposed on a front portion 410*a* and 410*b* of the support system. Pads 406 may be adhered to the second inner support layer. The fused seam 408 and support seam 414 may be attached to one another to provide circumferential support when worn. The second inner support layer may include a rear pucker 405 (see 4B) and a front pucker 415 (see FIG. 4C).

The following description of variants is only illustrative of components, elements, acts, products, and methods considered to be within the scope of the invention and are not in any way intended to limit such scope by what is specifically disclosed or not expressly set forth. The components, elements, acts, products, and methods as described herein may be combined and rearranged other than as expressly described herein and are still considered to be within the scope of the invention.

According to variation 1, a garment may include a first front outer layer including a first material; a second inner support layer including a support system, a backing, a rear seam, a support seam, and at least one molded cup; a third back outer layer including the first material, the third back outer layer being opposite the first front outer layer; and wherein at least one molded cup and backing are attached to one another to provide circumferential support when worn.

According to variation 2, a garment may include a first front outer layer including a first material; a second inner support layer, a backing, a rear seam, a support seam, and at least one molded cup, wherein the support system further includes a first support material and a second support material separate by the rear seam and the support seam; a third back outer layer including the first material, the third back outer layer being opposite the first front outer layer; and wherein at least one molded cup and backing are attached to one another to provide circumferential support when worn.

According to variation 3, a garment may include a first front outer layer including a first material; a second inner support layer including a puckered support system, a backing, a rear seam, a support seam, and at least one pad; a third back outer layer including the first material, the third back outer layer being opposite the first front outer layer; and wherein the rear seam and the support seam are attached to one another to provide circumferential support when worn.

According to variation 4, a garment may include a first front outer layer including a first material; a second inner support layer including a puckered support system, a backing, a rear seam, a support seam, and at least one pad, wherein the support system further includes a first support material and a second support material separate by the rear seam and the support seam; a third back outer layer including the first material, the third back outer layer being opposite the first front outer layer; and wherein the rear seam and the support seam are attached to one another to provide circumferential support when worn.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for anyone of the elements in the claims below or that a single element can be substituted for two or more elements in a claim. Although elements can be described above as acting in certain combinations, and even initially claimed as such, it is to be expressly understood that one or more elements from a claimed combination can, in some cases, be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible considering the above teachings without departing from the following claims.

I claim:

1. A garment comprising:

a first front outer layer comprising a first material;

a second inner support layer comprising a support system, a backing, a rear seam, a support seam, and at least one molded cup;

a third back outer layer comprising the first material, the third back outer layer being opposite the first front outer layer; and wherein at least one molded cup and backing are attached to one another to provide support when worn.

2. The garment of claim 1, further comprising a support system.

3. The garment of claim 1, wherein the support system further comprises a first support material and a second support material.

4. The garment of claim 1, wherein the rear seam and the support seam are attached to one another to provide support when worn.

5. The garment of claim 1, wherein the garment is comprised at least partially of an elastic material.

6. The garment of claim 5, wherein the first outer layer and the third back outer layer are comprised of at least one of the following materials: spandex, elastane, or modal.

7. The garment of claim 6, wherein the second inner support layer is attached to an interior of the first front outer layer to prevent shifting of the second inner support layer.

8. The garment of claim 7, wherein the second inner support layer is covered by the first front outer layer.

9. A garment comprising:

a first front outer layer comprising a first material;

a second inner support layer comprising a puckered support system, a backing, a rear seam, a support seam, and at least one pad, wherein the support system further comprises a first support material and a second support material separate by the rear seam and the support seam;

a third back outer layer comprising the first material, the third back outer layer being opposite the first front outer layer; and wherein the rear seam and the support seam are attached to one another to provide support when worn.

10. The garment of claim 9, wherein the first outer layer and the third back outer layer are comprised of at least one of the following materials: spandex, elastane, or modal.

11. The garment of claim 10, wherein the second inner support layer is attached to an interior of the first front outer layer to prevent shifting of the second inner support layer.

12. The garment of claim 11, wherein the second inner support layer is covered by the first front outer layer.

13. The garment of claim 12, wherein the second inner support layer includes a support system.

14. The garment of claim 13, wherein the support system is constructed of at least one of the following: two cups, a nylon material, or a spandex material.

* * * * *